US006644561B1

(12) United States Patent
Daane

(10) Patent No.: US 6,644,561 B1
(45) Date of Patent: Nov. 11, 2003

(54) COLOR BEAM SPRINKLER LIGHTS

(76) Inventor: Patrick David Daane, 505 Tranquil Dr., Sparks, NV (US) 89436

( * ) Notice: Subject to any disclaimer, the term of this patent is extended or adjusted under 35 U.S.C. 154(b) by 0 days.

(21) Appl. No.: 10/096,738

(22) Filed: Mar. 12, 2002

(51) Int. Cl.[7] ..... F21S 8/00

(52) U.S. Cl. ..... 239/18; 239/16; 239/17; 200/61.58 R

(58) Field of Search ..... 239/16–23, 200, 239/211; 200/61.58 R, 61.6

(56) References Cited

U.S. PATENT DOCUMENTS

| | | | | | |
|---|---|---|---|---|---|
| 219,946 | A | * | 9/1879 | Huber | 239/23 |
| 1,837,732 | A | * | 12/1931 | Stabler | 239/18 |
| 1,903,974 | A | * | 4/1933 | Brink | 239/18 |
| 2,034,792 | A | * | 3/1936 | Bergman | 239/18 |
| 2,593,517 | A | | 4/1952 | Angulo | |
| D182,605 | S | | 4/1958 | Litchfield | |
| 2,883,114 | A | | 4/1959 | Horvath | |
| 3,162,367 | A | | 12/1964 | Nowack | |
| 3,814,317 | A | * | 6/1974 | Hruby, Jr. | 239/18 |
| 4,408,717 | A | * | 10/1983 | Rynberk | 239/18 |
| 4,739,934 | A | | 4/1988 | Gewelber | |
| 5,823,431 | A | | 10/1998 | Pierce | |
| 6,076,741 | A | * | 6/2000 | Dandrel et al. | 239/18 |

* cited by examiner

*Primary Examiner*—Michael Mar
*Assistant Examiner*—Dinh Q. Nguyen
(74) *Attorney, Agent, or Firm*—Gene Scott-Patent Law & Venture Group

(57) ABSTRACT

A colored light water sprinkler head comprises an enclosure having a cylindrical body adapted at a lower end thereof, for engaging a water supply pipe. The cylindrical body encloses light projecting devices interconnected in an electrical circuit for switching a light display on and off. A water dispensing tube is engaged for linear motion within the enclosure and is adapted for moving between an upwardly extended position under the force of water pressure delivered through the water supply pipe, and a downwardly retracted position under the force of a retraction spring when the water pressure force is absent. The light projecting devices are positioned for directing light toward the dispensing tube when in the extended position.

3 Claims, 3 Drawing Sheets

COLOR BEAM SPRINKLER LIGHTS

BACKGROUND OF THE INVENTION

1. Field of the Invention

This invention relates generally to lawn sprinklers and more particularly to a lawn type sprinkler with incorporated light show.

2. Description of Related Art

The following art defines the present state of this field:

Litchfield, U.S. Pat. No. D182,605 describes an illuminable lawn sprinkler design.

Angulo, U.S. Pat. No. 2,593,517 describes a sprinkler comprising, a base, a first tubular supporting member extending upwardly from said base, a housing rotatably mounted on said first tubular supporting member and including a translucent portion through which light may pass, a stationary lamp within the housing, a second tubular supporting member disposed within, fixed to and supported by said first tubular supporting member and having the lamp mounted on the upper end thereof and having its lower end passing through the wall of said first tubular supporting member, means for connecting a water supply conduit to said first tubular supporting member, and electric leads within the second tubular supporting member and connected at one set of ends to the lamp and at the other set of ends to a plug on the lower end of said second tubular supporting member.

Horvath, U.S. Pat. No. 2,883,114 describes a lawn sprinkler or the like of the type having a pedestal member rotatably supporting a sprinkler head member on its upper end comprising, at least one light source positioned about said pedestal, and a hood structure extending about said pedestal member and positioned about said source of light adapted to illuminate at least part of the trajectory of water sprayed from said sprinkler head member during its operation, means rotatably supporting said hood structure to said pedestal member, water retaining means attached to said hood structure for holding a predetermined depth of water about said pedestal member, and drive means attached to said sprinkler head member and adapted to engage water in said water retaining means thereby providing a driving connection between said sprinkler head member and said hood structure.

Nowack, U.S. Pat. No. 3,162,367 describes a garden spray and light unit comprising a vertical disposed elongated tubular base open at its upper end and closed at its bottom end, and inwardly extending annulus connected to said base adjacent its open end, a clear lens supported by said annulus closing said upper end of a base, a spray head connected to said lens and having water connection connected thereto, to provide a spray when water is delivered, a lamp supported on the bottom end of the base having an electrical connection for providing light rays through a spray from the spray head which is connected to a source of electricity, and vent means in the base spaced from its ends to provide air flow for cooling the lamp, having tabs bent outwardly to form the vent and provide shields to prevent water from passing through the vents, a second lens disposed in the upper end of said base below the lens supporting the spray head, the connected lens and spray head being removable to provide garden lamp unit when a spray is not desired, and a hole having spaced upper and lower surfaces each with an opening therethrough aligned with the opening in the other surface, the base with only the second lens connected to the bottom surface in the opening therein, connected spray head and lens supported in the opening of the upper surface, a motor mounted on the bottom, and a color wheel connected to and rotated by the color to provide various colors to the light from the lamp.

Gewelber, U.S. Pat. No. 4,739,934 describes a sprinkler head which is molded with a large number (such as twelve or sixteen) of potential orifices and directing channels with the orifices all plugged or occluded with comparatively light barriers or plugs of the molded plastic material which are readily punctured and removed by the user. In this way the user may select among many possible watering patterns including not only the above described full, one-half, and one-fourth circles, but may also choose to punch one orifice, giving a thirty or twenty-two and one-half degree arc, then skip one or two plugs, then punch another plug or two. In this manner one or a number of orifices may remain blocked making it possible to, for example, water a thirty degree arc, skip sixty degrees, water another thirty of sixty degree arc, etc. Many such patterns become possible. In one of the embodiments disclosed, the design allows access to the puncturable barriers or plugs from the bottom which means that the user must puncture the desired pattern or orifices before installing the head on the riser pipe. A second embodiment allows access to the puncturable barriers from the head as installed.

Pierce, U.S. Pat. No. 5,823,431 describes a new Illuminated Lawn Sprinkler for which provides an aesthetically pleasing display of light and color through illuminated water patterns. The inventive device includes lighting fixture with removable lens, water sensor means which controls the battery operated water source.

The prior art teaches the use of illuminated lawn sprinklers but does not teach the particular adaptation of the present invention which provides novel advantages as described in the following summary.

SUMMARY OF THE INVENTION

The present invention teaches certain benefits in construction and use which give rise to the objectives described below.

A colored light water sprinkler head comprises an enclosure having a cylindrical body adapted at a lower end thereof, for engaging a water supply pipe. The cylindrical body encloses light projecting devices interconnected in an electrical circuit for switching a light display on and off. A water dispensing tube is engaged for linear motion within the enclosure and is adapted for moving between an upwardly extended position under the force of water pressure delivered through the water supply pipe, and a downwardly retracted position under the force of a retraction spring when the water pressure force is absent. The light projecting devices are positioned for directing light toward the dispensing tube when in the extended position.

A primary objective of the present invention is to provide an apparatus and method of use of such apparatus that provides advantages not taught by the prior art.

Another objective is to provide such an invention capable of providing a light show when a lawn type water sprinkler is activated.

A further objective is to provide such an invention capable of activation by water pressure.

A still further objective is to provide such an invention capable of deactivation when water pressure is lost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
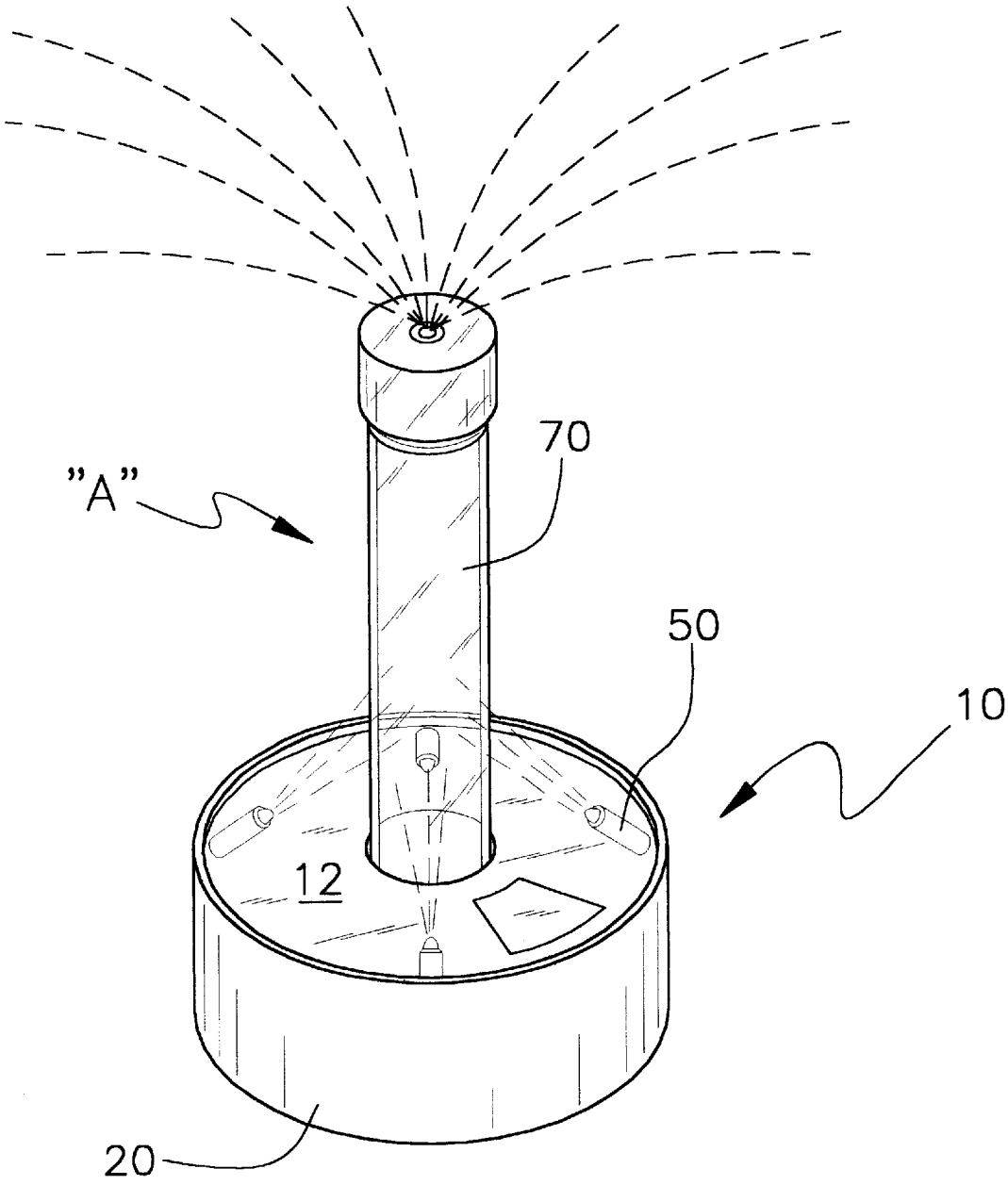
FIG. 1 is a perspective view of the preferred embodiment of the invention showing an upper portion thereof.
Figure 2:
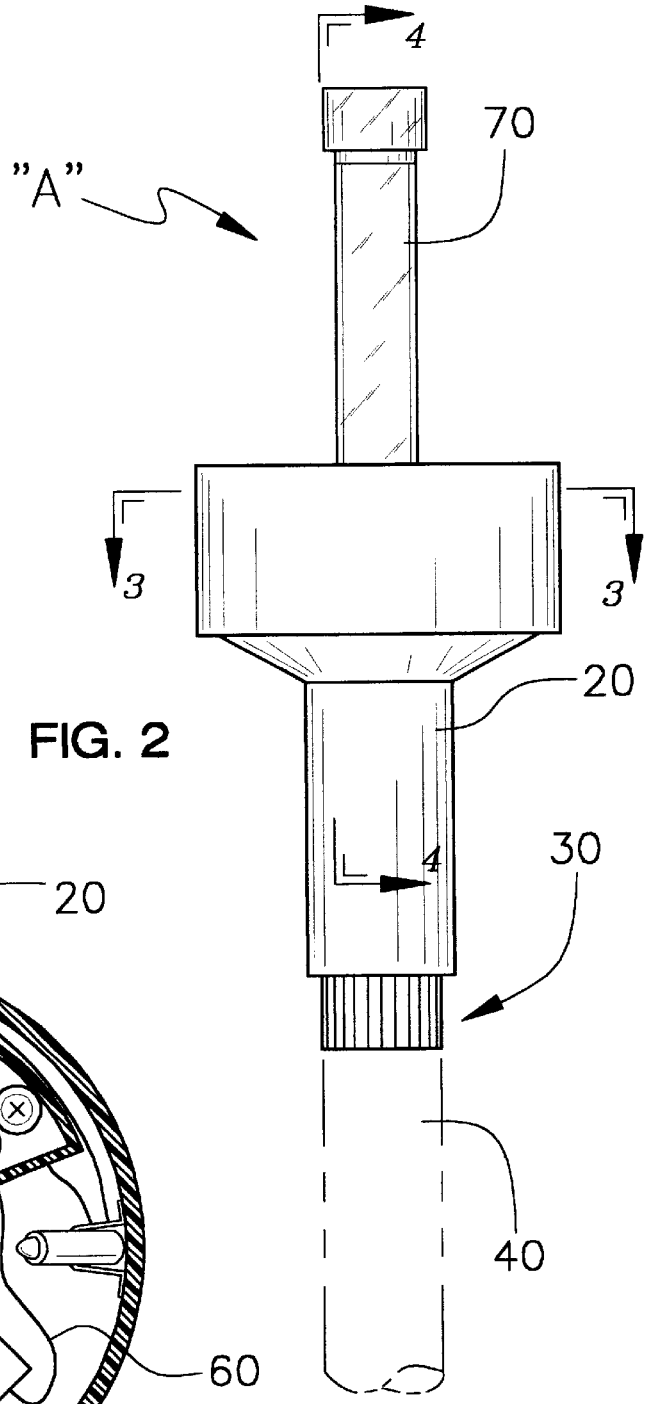
FIG. 2 is a side elevation view thereof.
Figure 3:
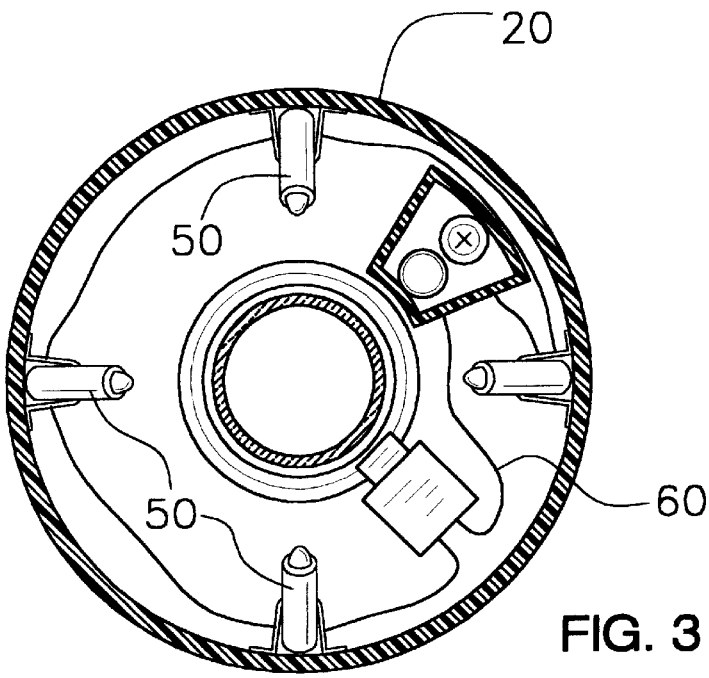
FIG. 3 is a section view thereof taken along line 3—3 in FIG. 2.

The above described drawing figures illustrate the invention in at least one of its preferred embodiments, which is further defined in detail in the following description.

The present invention apparatus comprises an enclosure 10 having a cylindrical body 20 adapted at a lower end thereof 30, for engaging a water supply pipe 40. The cylindrical body 20 encloses a light projecting means 50 interconnected in an electrical circuit 60 for switching the light projecting means 50 on and off. A water dispensing tube 70 is engaged for linear vertical motion within the enclosure 10 and is adapted for moving between an extended position "A" under the force of water pressure delivered through the water supply pipe 40, and a retracted position under the force of a retraction spring 65 when the water pressure force is absent. In the retracted position the dispensing tube 70 is fully enclosed within the cylindrical body 20. The light projecting means 50 is adapted by its position for directing light toward the dispensing tube 70 when it is in the extended position "A."

Figure 4:
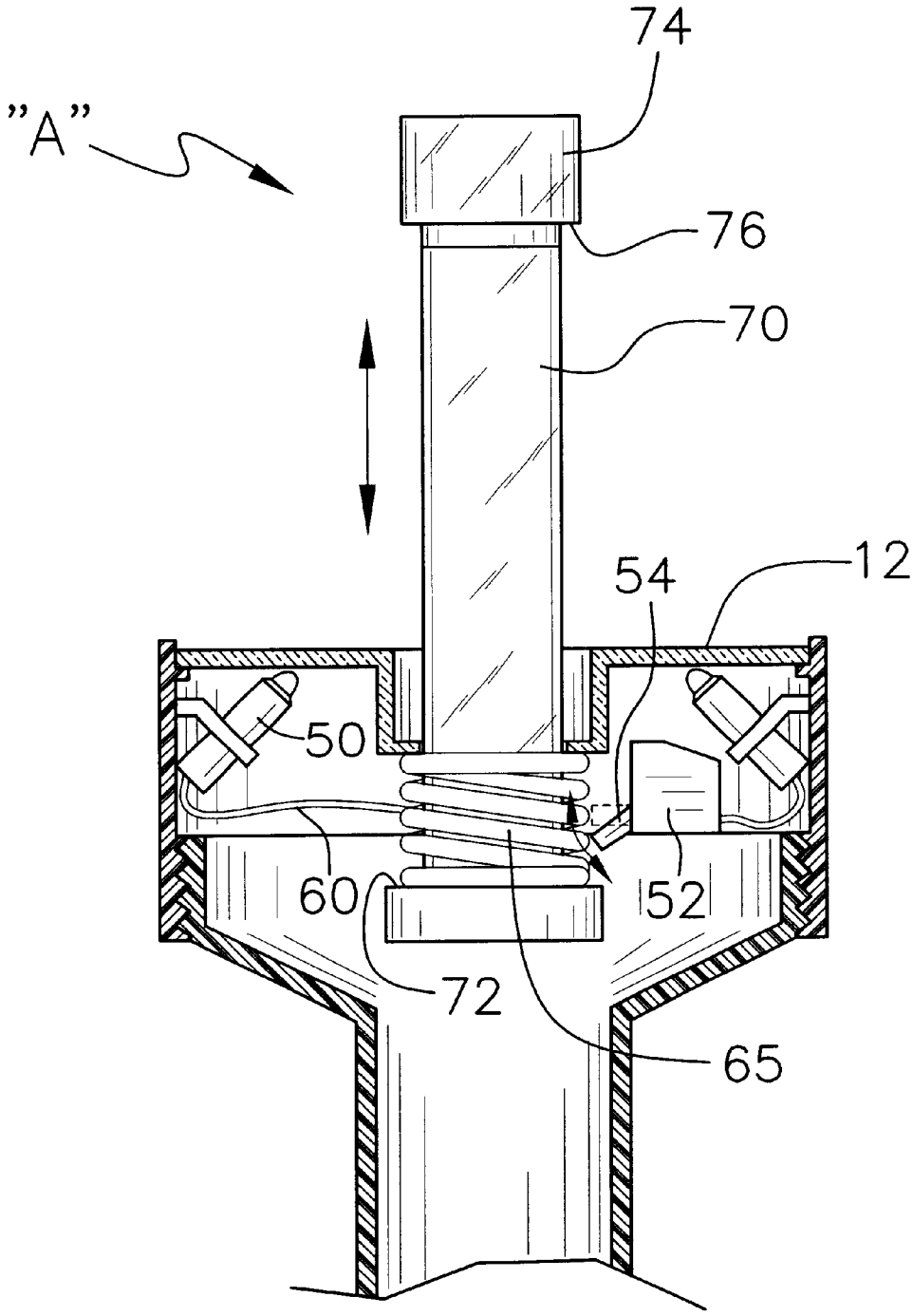
FIG. 4 is section view thereof taken along line 4—4 in FIG. 2.

The electrical circuit 60 comprises the light projecting means 50, an electrical on-off switch 52 (FIG. 4) adapted for engaging the dispensing tube 70 such that the electrical circuit 60 is energized when the dispensing tube 70 is in the extended position "A" and deenergized when the dispensing tube 70 is in the retracted position. To accomplish this circuit action, the dispensing tube 70 provides an annular flange 72 positioned for contact with a toggle arm 54 on the electrical switch 52 when the tube 70 is in its extreme upward extension, as shown in FIG. 4, which turns the circuit 60 to the "on" state. Likewise, when the water force is not present, the annular flange 72 and tube 70 will retract. The spring action of the toggle arm 54 will then place the electrical circuit 60 in the "off" state.

The enclosure 10 provides a transparent, upwardly directed, cover plate 12 for admitting the directed light therethrough so as to project this light in an upward direction. Preferably, the dispensing tube 70 is also transparent so that the projected light is able to play on the water as it moves through the dispensing tube 70.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An apparatus comprising: an enclosure having a cylindrical body having a lower end thereof, the lower end engaging a water supply pipe; the cylindrical body enclosing a means for light projecting, wherein the light projecting means is interconnected in an electrical circuit, the circuit enabled for switching the light projecting means on and off; a water dispensing tube engaged for linear motion within the enclosure, the dispensing tube movable between an extended position under the force of water pressure delivered through the water supply pipe, and a retracted position under the force of a retraction spring when the water pressure force is absent, the light projecting means positioned to direct light toward the dispensing tube, when the dispensing tube is in the extended position; the light projecting means engaged with an electrical on-off switch, the switch engaging the dispensing tube such that the electrical circuit is energized when the dispensing tube is in the extended position and the electrical circuit is deenergized when the dispensing tube is in the retracted position.

2. The apparatus of claim 1 wherein the cylindrical body provides a cover plate, the cover plate being transparent and upwardly directed for admitting the directed light therethrough.

3. The apparatus of claim 1 wherein the dispensing tube is transparent.

* * * * *